US006644565B2

(12) United States Patent
Hockenberger

(10) Patent No.: US 6,644,565 B2
(45) Date of Patent: Nov. 11, 2003

(54) FUEL INJECTION NOZZLE FOR SELF-IGNITING INTERNAL COMBUSTION ENGINES

(75) Inventor: Axel Hockenberger, Eblok (TR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/138,246

(22) Filed: May 6, 2002

(65) Prior Publication Data

US 2002/0158152 A1 Oct. 31, 2002

Related U.S. Application Data

(63) Continuation-in-part of application No. 09/581,629, filed as application No. PCT/DE99/02204 on Jul. 16, 1999.

(30) Foreign Application Priority Data

Oct. 15, 1998 (DE) ..... 198 47 460

(51) Int. Cl.[7] ..... F02M 59/00

(52) U.S. Cl. ..... 239/533.2; 239/533.12; 239/601

(58) Field of Search ..... 239/533.2, 533.9, 239/533.12, 88, 601

(56) References Cited

U.S. PATENT DOCUMENTS 4,069,978 A * 1/1978 El Moussa ..... 239/533.2
5,092,039 A * 3/1992 Gaskell ..... 239/533.12
5,934,571 A * 8/1999 Schmidt et al. ..... 239/533.9

FOREIGN PATENT DOCUMENTS

JP 405231273 A * 9/1993

* cited by examiner

*Primary Examiner*—Michael Mar
*Assistant Examiner*—Dinh Q. Nguyen
(74) *Attorney, Agent, or Firm*—Ronald E. Greigg

(57) ABSTRACT

A fuel injection nozzle for self-igniting internal combustion engines, having a nozzle body in which a conical valve seat face is formed on the injection end of a bore, from which face the injection ports extend, and having a valve needle, opening counter to a closing force counter to the flow direction of the fuel, which needle is guided displaceably in the entrance region of the bore remote from the injection end and which on its side toward the valve seat face has a closing cone, which cooperates with the valve seat face, is characterized in that the injection port cross section toward the combustion chamber of the engine, after initially narrowing, widens again.

2 Claims, 3 Drawing Sheets

FUEL INJECTION NOZZLE FOR SELF-IGNITING INTERNAL COMBUSTION ENGINES

This is Continuation-in-Part of Ser. No. 09/581,629, filed Jul. 20, 2000.

CROSS-REFERENCE TO RELATED APPLICATIONS

This application is a 35 U.S.C. 371 application of PCT/DE 99/02204, filed on Jul. 16, 1999.

BACKGROUND OF THE INVENTION

1. Field of the Invention

The invention relates to a fuel injection nozzle for self-igniting internal combustion engines.

2. Description of the Prior Art

Fuel injection nozzles of this type with which this invention is concerned are known, for instance, from German Patent DE 43 03 813 C1 and from the published book entitled Bosch Kraftfahrtechnisches Taschenbuch [Bosch Automotive Handbook], 22nd Edition, 1995, pages 526 ff.

In such fuel injection nozzles, the injection ports are embodied cylindrically. The conversion of the fuel pressure into a speed of the injected fuel stream is done inside a small region, which results in great losses of efficiency.

According to the present invention a fuel injection nozzle of this type provides an increase in efficiency in the conversion of the fuel pressure into a speed of the fuel stream fed in, and as a result the efficiency of fuel distribution in the engine, are increased. The fuel injection nozzle is also intended to reduce NOx in particulate values.

ADVANTAGES OF THE INVENTION

Because the injection port cross section toward the combustion chamber of the engine, after initially narrowing, widens again, an optimal conversion of the pressure into a speed of the fuel stream and thus high efficiency of fuel distribution in the internal combustion engine is attained in an especially simple way. While specifically in the convergent region of the fuel injection nozzle higher speeds are generated, while in its divergent portion it is possible to generate a spray with small particles. Thus a shift in the region of maximum distribution away from the fuel injection nozzle because of higher speeds of the fuel stream that emerges from the fuel injection nozzle known from the prior art is advantageously counteracted by the divergent portion of the fuel injection nozzle. As a result of an optimal conversion of the pressure of the fuel stream into its speed, the tendency to cavitation is thus also reduced. The smallest injection port cross section advantageously extends in the axially middle region of the injection port opening, so that the divergent and the convergent injection port regions each have about the same axial length.

Furthermore, such a fuel injection nozzle can be produced especially economically, for instance by spark erosion.

With respect to the embodiment of the injection ports, the most various forms are possible. Advantageously, the injection ports have one of the following cross-sectional shapes: a circular form, an elliptical form, or slitlike form.

BRIEF DESCRIPTION OF THE DRAWINGS

Further advantages and advantageous features of the subject of the invention can be learned from the description contained herein below, taken in conjunction with the drawings, in which.

DESCRIPTION OF THE PREFERRED EMBODIMENT

Figure 1:
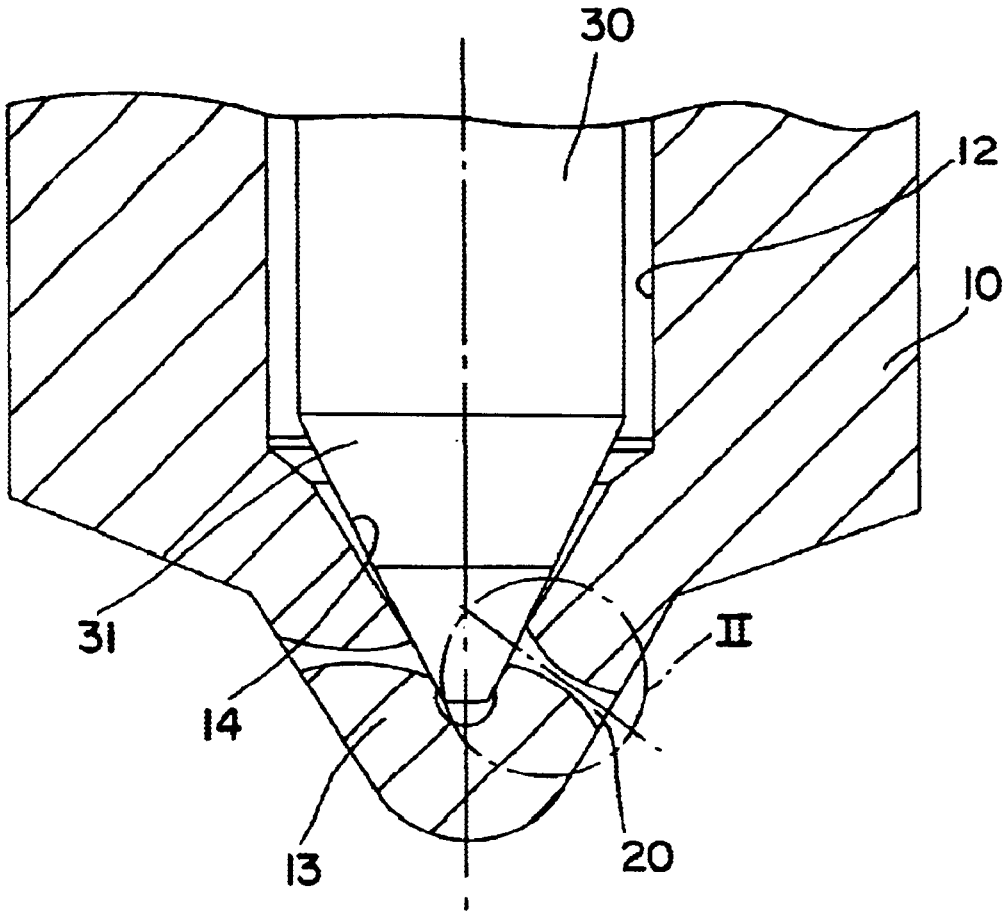
FIG. 1, a longitudinal section through the lower region of a fuel injection valve of the invention.

A valve body 10 has a bore 12, whose bottom is embodied as a conical valve seat face 14 in a cup 13 on the injection end.

Cooperating with this valve seat face 14, from which injection ports 20 originate that penetrate the cup 13 and discharge into the combustion chamber, is a closing cone 31 of complementary shape at the tip of a valve needle 30. The valve needle 30, loaded by a closing spring (not shown), has both a guide portion, guided displaceably in the entrance region of the nozzle body 10, and a following portion of reduced diameter via a pressure shoulder; the closing cone 31 is formed onto the free walls of this following portion. The following portion of the valve needle 30 has a thickness that is less than the width of the surrounding bore 12, so that an annular gap surrounds it; in a manner known per se, at the level of the pressure shoulder, this gap widens into a chamber (not shown) that communicates with a supply bore.

Figure 2:
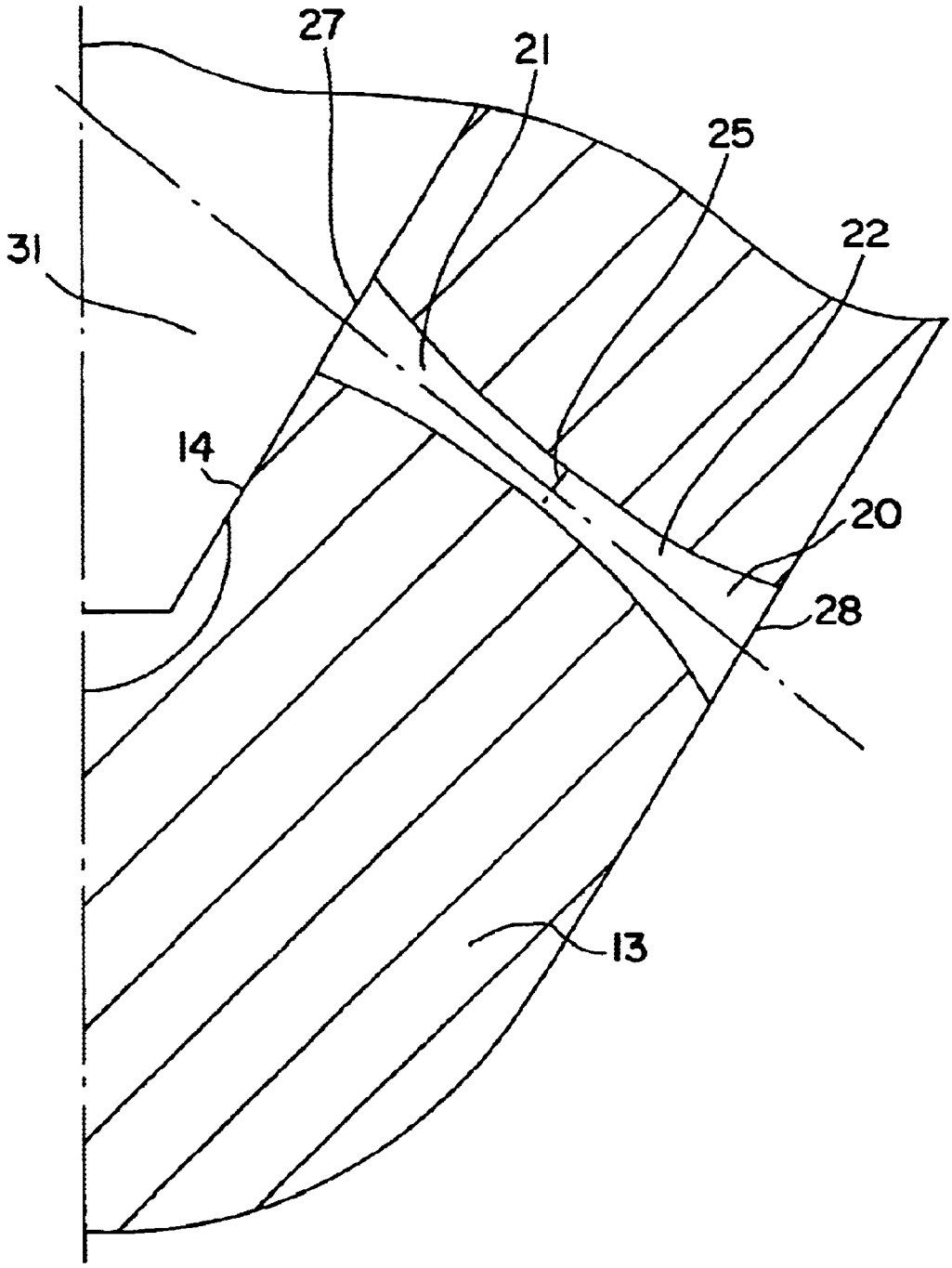
FIG. 2, an enlarged detail, marked II in FIG. 1, of the fuel injection nozzle shown in FIG. 1.

As seen from FIG. 1 and in particular from FIG. 2, the injection port 20, after an initial narrowing toward the combustion chamber of the engine, has a cross section that widens again. A convergent portion 21 is followed by a divergent portion 22. In this respect, the injection port has the form of what is known as a "Laval nozzle". As in a Laval nozzle, higher speeds of the fuel stream to be injected are generated in the convergent region 21 of the fuel injection nozzle, while in the divergent portion of the nozzle, conversely, a spray of small particles is created. An undesired shift in the region of maximum distribution away from the nozzle because of the higher speed of the fuel injection port is thus counteracted by means of the divergent portion 22 of the fuel injection nozzle. The resultant "gentler" conversion of the pressure of the fuel injection stream into its speed reduces the cavitation tendency of the fuel injection nozzle.

In FIG. 2, the injection port 20 is shown again, enlarged. It has an inner end 27 and an outer end 28; the inner end 27 is disposed in the valve seat face 14. The convergent part 21 of the injection port is distinguished in that the cross section decreases strictly monotonously and decreases down to a smallest cross section 25. The smallest cross section 25 is embodied here at precisely one point in the injection port 20, specifically, viewed in the longitudinal direction of the injection port 20, in the center between the inner end 27 and the outer end 28. The smallest cross section 25 is adjoined by the convergence part 22, which is distinguished in that the cross section of the injection port 20 increases continuously and strictly monotonously as far as the outer end 28 of the injection port 20. The smallest cross section 25 embodied at precisely one point thus forms the boundary between the convergent part 21 and the divergent part 22 of the injection port 20. In this case, which is shown in FIG. 2, the smallest cross section 25 is located precisely in the center of the injection port 20, so that the divergent part 22 is embodied as the mirror image of the convergent part 21. Viewed in the longitudinal section of the injection port 20, the smallest cross section 25 is disposed in the center of the injection port 20, and so the convergent part 21 and divergent part 22 each have the same axial length.

Figure 3:
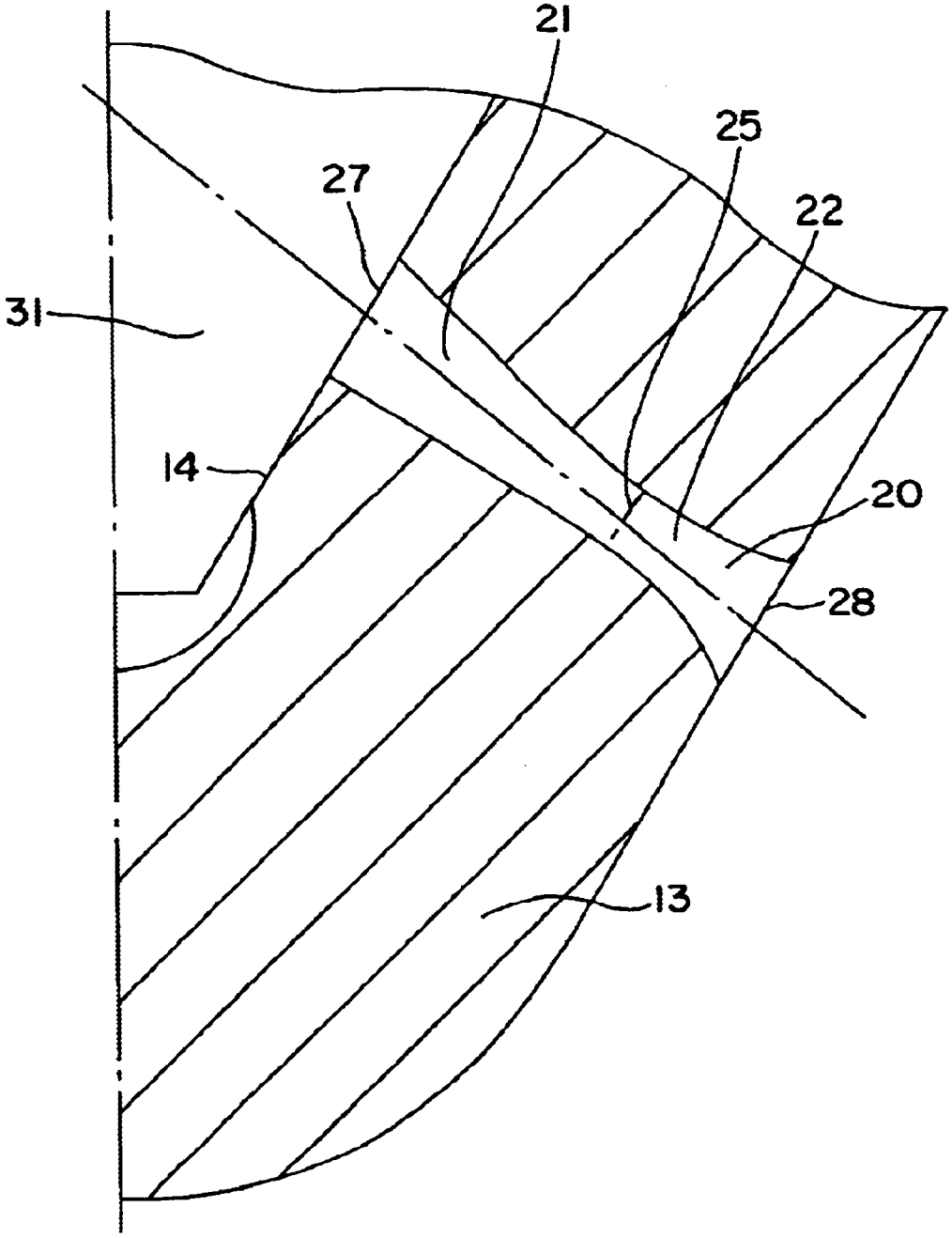
FIG. 3, an enlarged detail similar to FIG. 2, however showing an alternative embodiment.

FIG. 3 shows a further exemplary embodiment of the fuel injection valve of the invention. Here the injection port 20 has a smallest cross section 25, which viewed in the longitudinal direction of the injection port 20 is disposed closer to the outer end 28 of the injection port than to the inner end 27. As a result, the convergent part 21 of the injection port 20 has a greater axial length than the divergent part 22, but as before the smallest cross section 25 separates the two parts 21, 22 of the injection port 20. The ratio of the convergent part 21 to the divergent part 22 is for instance 2 to 1, which optimizes the flow conditions in the injection port 20. Furthermore, this has the advantage that because of the divergent outer part 22 of the injection port 20, carbonization residues that can form on the outside of the cup 13 reduce the flow rate of the fuel inside the injection port 20 only slightly.

Such a fuel injection nozzle can be produced in a highly advantageous way by spark erosion; the variation of the cross-sectional shape of the injection port 20 can be achieved in a simple way by varying the parameters of voltage, current intensity, and feeding speed. The costs for producing this kind of injection port can be less than in the conical injection ports known from the prior art, in which the entrance cross section is larger than the exit cross section. Since the entrance openings in fuel injection nozzles known from the prior art are in many cases additionally rounded hydroerosively, the costs for producing a fuel injection nozzle equipped with injection ports 20 as described above can even be reduced, since the time needed for rounding the entrance openings can be reduced, or this operation can even be omitted.

The foregoing relates to preferred exemplary embodiments of the invention, it being understood that other variants and embodiments are thereof possible within the spirit and scope of the invention, the latter being defined by the appended claims.

I claim:

1. A fuel injection nozzle for self-igniting internal combustion engines, having a nozzle body (10) with an elongated bore (12), one end of which is an injection end in which a conical valve seat face (14) is formed and from which face at least one injection port (20) extends, the injection nozzle including a valve needle (30) which opens counter, to the flow direction of the fuel, which valve needle (30) is guided displaceably in the end of the elongated bore (12) opposite the injection end, and which valve needle (30), on its end toward the valve seat face (14), has a closing cone (31) which cooperates with the valve seat face (14), characterized in that each of the at least one injection ports (20) have cross sections which, beginning at the valve seat face (14) decreases continuously as far as a smallest cross section (25), embodied at precisely one point, and from there on widens again continuously, so that a convergent part (21) of the injection port (20) and a divergent part (22) of the injection port (20) are separated from one another by the smallest cross section (25), wherein the smallest cross section is disposed between the center and the outer end (28) of the injection port (20).

2. The fuel injection nozzle of claim 1, characterized in that the convergent part (21) and the divergent part (22) each have an axial length, and the axial length of the convergent part (21) is twice as great as the axial length of the divergent part (22) of the injection port (20).

* * * * *